US007872847B2

(12) United States Patent
La Rochelle

(10) Patent No.: US 7,872,847 B2
(45) Date of Patent: Jan. 18, 2011

(54) ELECTRIC-CHARGE PROTECTIVE EQUIPMENT

(76) Inventor: Simon La Rochelle, 236 Avery, Granby, Québec (CA) J2G 9J6

( * ) Notice: Subject to any disclaimer, the term of this patent is extended or adjusted under 35 U.S.C. 154(b) by 177 days.

(21) Appl. No.: 12/376,996

(22) PCT Filed: Aug. 13, 2007

(86) PCT No.: PCT/CA2007/001409

§ 371 (c)(1),
(2), (4) Date: Feb. 10, 2009

(87) PCT Pub. No.: WO2008/017166

PCT Pub. Date: Feb. 14, 2008

(65) Prior Publication Data

US 2010/0165536 A1 Jul. 1, 2010

Related U.S. Application Data

(60) Provisional application No. 60/890,549, filed on Feb. 19, 2007.

(30) Foreign Application Priority Data

Aug. 11, 2006 (WO) ..... PCT/IB2006/052789

(51) Int. Cl.
*H05F 3/00* (2006.01)

(52) U.S. Cl. ..... 361/223; 361/212; 361/224

(58) Field of Classification Search ..... 361/223, 361/224

See application file for complete search history.

(56) References Cited

U.S. PATENT DOCUMENTS

| | | | |
|---|---|---|---|
| 493,782 | A | 3/1893 | Plecker |
| 2,261,072 | A | 4/1941 | Monahan |
| 2,712,099 | A | 6/1955 | Legge |
| 6,031,270 | A | 2/2000 | Williamson et al. |
| 6,421,222 | B1 | 7/2002 | Maritz et al. |
| 6,549,391 | B1 | 4/2003 | Bisson |
| 6,721,161 | B2 | 4/2004 | Lee et al. |
| 6,873,516 | B1 | 3/2005 | Epstein |
| 6,876,529 | B2 | 4/2005 | Li |
| 6,982,861 | B2 | 1/2006 | Lee et al. |

FOREIGN PATENT DOCUMENTS

| | | |
|---|---|---|
| CA | 2367542 | 4/2002 |

*Primary Examiner*—Jared J Fureman
*Assistant Examiner*—Terrence R Willoughby
(74) *Attorney, Agent, or Firm*—Ogilvy Renault LLP

(57) ABSTRACT

Protective equipment for safely discharging electrical potential comprises an interface (10, 50, 60) adapted to be in contact with a wearer. A conductive path in the interface contacts the wearer, the conductive path reaching a ground. A first circuit device (30) is provided in the conductive path. The first circuit device (30) has at least one variable resistance so as to oppose a first level of variable resistance to decrease a conductivity in the conductive path as a function of an increase in potential difference between the wearer and the ground, to allow static discharge through the protective equipment.

9 Claims, 4 Drawing Sheets

ELECTRIC-CHARGE PROTECTIVE EQUIPMENT

CROSS-REFERENCE TO RELATED APPLICATIONS

The present patent application claims priority on International Patent Application PCT/IB2006/052789, filed on Aug. 11, 2006, and on U.S. Provisional Patent Application 60/890,549, filed on Feb. 19, 2007.

FIELD OF THE APPLICATION

The present application relates to electric-shock prevention, and more particularly to protective equipment used as protection against electrical discharges.

BACKGROUND OF THE ART

Interactions of the human being with his/her environment (such as friction through movements) causes an accumulation of a static charge on the human being. Humans typically wear non-conductive clothing (e.g., rubber-sole shoes which are an efficient insulator), which enhances the accumulation of a static charge by the human. More specifically, clothing is often the interface between the human and the ground. When the interface has insulating properties (e.g., shoes with rubber soles), the human accumulates a static charge. As such, when an object representing a ground is contacted, the human feels an unpleasant static shock as the charge is discharged to the ground.

In some workplaces, the level of static charge on workers is controlled. As an example, in the field of electronics, a 100 V charge may cause damage to electronic components, such as the erasure of data on magnetic data medium, even though the worker does not feel the discharge of such a charge. In operating with hydrocarbons (petroleum and gas industries), a 50 V charge may spark flammable vapors. In the plastics industry, static charges may be of such magnitudes that severe injuries resulting from electrical shocks have occurred. The control of static charge is therefore important, whether it be for the security of workers or for maintaining levels of productivity.

Protective equipment, such as shoes, wrist bands, heel pads, ankle bracelets, has been developed to control the charge of workers. However, if such protective equipment is highly conductive, there is an increased risk of electrocution for the wearer. The wearer of highly conductive protective gear may become a ground for high-voltage machinery or wires.

A plurality of products have been developed and patents have been granted to address the need for conductive, insulated or antistatic gear. Examples of patents include U.S. Pat. No. 493,782, U.S. Pat. No. 2,261,072, U.S. Pat. No. 2,712,099, amongst others.

SUMMARY OF THE APPLICATION

It is therefore an aim of the present invention to provide electric-charge protective equipment that addresses issues associated with the prior art.

Therefore, in accordance with the preferred embodiment, there is provided protective equipment for safely discharging electrical potential comprising: an interface adapted to be in contact with a wearer; a conductive path in the interface contacting the wearer, the conductive path reaching a ground; and a first circuit device in the conductive path, the first circuit device having at least one variable resistance so as to oppose a first level of variable resistance to decrease a conductivity in the conductive path as a function of an increase in potential difference between the wearer and the ground, to allow static discharge through the protective equipment.

Further in accordance with the preferred embodiment, the first circuit device comprises a first resistance and a first pair of transistors, with the first pair of transistors arranged with respect to the first resistance so as to offer the first level of variable resistance according to a potential difference across the first resistance in a direction of a current flow.

Still further in accordance with the preferred embodiment, the protective equipment comprises a second circuit device in the conductive path in series with the first circuit device, the second circuit device having a second resistance and a second pair of transistors, with the second pair of transistors being arranged with respect to the second resistance so as to offer a second level of variable resistance according to a potential difference across the second resistance in a direction of a current flow.

Still further in accordance with the preferred embodiment, the transistors of the first pair are mosfets, with the transistors arranged on opposed sides of the first resistance so as to operate in depletion mode when current flows from the wearer to the ground.

Still further in accordance with the preferred embodiment, the transistors of the first pair and of the second pair are mosfets, with the transistors of the first pair and of the second pair respectively arranged on opposed sides of the first resistance and of the second resistance so as to operate in depletion mode when current flows from the wearer to the ground.

Still further in accordance with the preferred embodiment, the interface is a shoe, the shoe having an insole, an insulating midsole, and an outsole, with the circuit device being accommodated in the midsole and in contact with the insole and the outsole.

Still further in accordance with the preferred embodiment, the insole has a conductive ribbon in contact with a conductive layer and with the circuit device, the conductive layer contacting a foot of the wearer.

Still further in accordance with the preferred embodiment, the outsole comprises at least one of a conductive heel portion and a conductive tab portion in contact with the circuit device.

Still further in accordance with the preferred embodiment, the interface is any one of a wrist band and an ankle band, with the interface being grounded.

DESCRIPTION OF PREFERRED EMBODIMENTS

Figure 1:
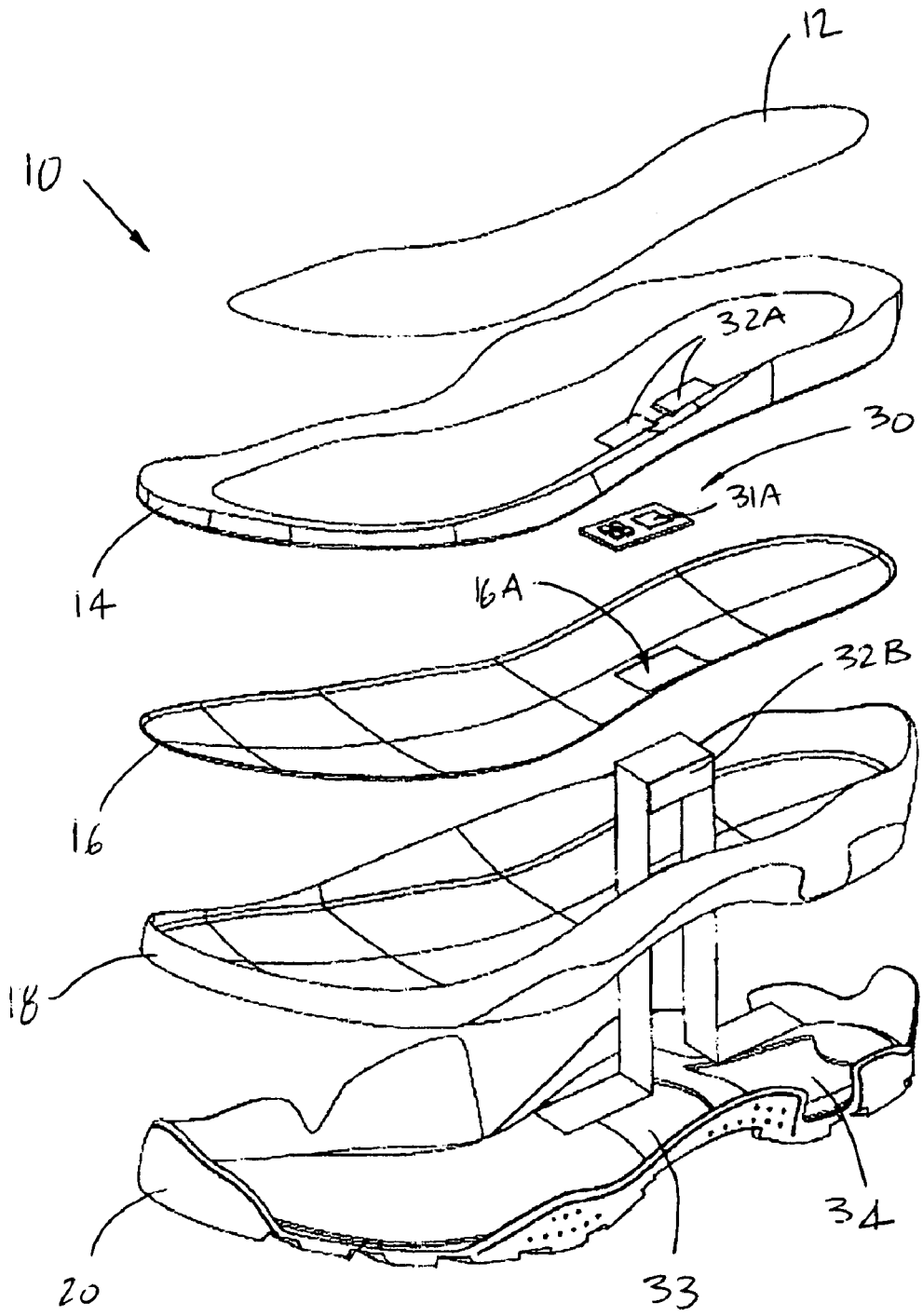
FIG. 1 is a top exploded view of an electric-charge protective shoe sole in accordance with an embodiment of the present invention.
Figure 2:
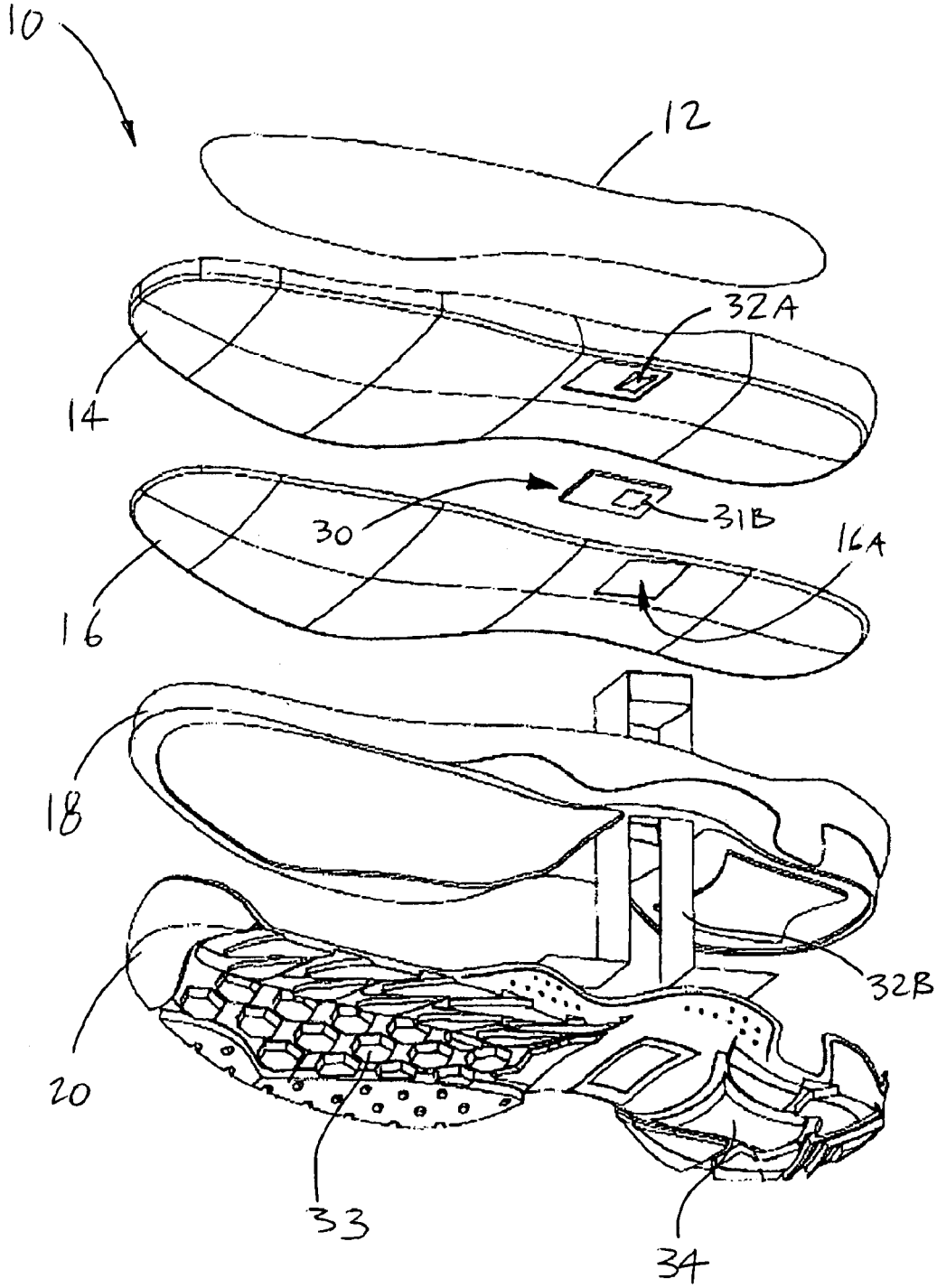
FIG. 2 is a bottom exploded view of the electric-charge protective shoe sole of FIG. 1.

Referring now to the drawings, and more particularly to FIGS. 1 and 2, an electric-charge protective shoe sole constructed in accordance with an embodiment is generally shown at 10. The shoe sole 10 has from top to bottom a conductive layer 12, an insole 14, an assembly base 16 for upper, a middle sole 18 and an outsole 20. Other layers can also be found in the shoe sole 10, or some of the above described layers may be optional.

The conductive layer 12 is the interface between the foot of the wearer and the shoe sole 10.

The insole 14 is the cleanliness layer, and is typically made of an absorbent material so as to absorb odors and humidity. The insole 14 is made of an electricity-insulating material.

The assembly base 16 is used to connect the upper to the shoe sole 10. Although not shown for clarity purposes, the upper may be integrally part of the assembly base 16. The assembly base features an opening 16A.

The middle sole 18 interrelates the assembly base 16 to the outsole 20. The middle sole 18 is made of an electricity-insulating material.

The outsole 20 is the interface of the shoe sole 10 with the ground.

Still referring to FIGS. 1 and 2, an electric-charge protective device as used with the shoe sole 10 is generally shown at 30. The protective device 30 is an electronic component that is accommodated in the shoe sole 10. The protective device 30 is associated with conductive elements so as to be part of the dissipation path for electric charges of the wearer.

More specifically, the protective device 30 has a top electrode 31A and a bottom electrode 31B. The top electrode 31A contacts a top conductive ribbon 32A. The top conductive ribbon 32A contacts the conductive layer 12 as well by passing through a pair of openings in the insole 14. As the insole 14 preferably consists of an insulating material, the conductive ribbon 32A forms the conductive path between the wearer and the protective device 30.

A bottom conductive ribbon 32B contacts the bottom electrode 31B of the protective device 30, and contacts both conductive tab portion 33 in the front of the outsole 20, and conductive heel portion 34 in the rear of the outsole 20, by passing through the opening 16A in the assembly base 16 and a pair of openings in the middle sole 18. As the middle sole 18 preferably consists of an insulating material, the conductive ribbon 32B forms the conductive path between the protective device 30 and the ground. The tab portion 33 and the heel portion 34 are typically made of conductive materials, such as selected conductive polymers or rubbers, amongst other materials. The conductive ribbons 32A and 32B are typically made of a metallic material, and may be as an alternative PCBs in the various layers of the shoe sole 10.

Figure 5:
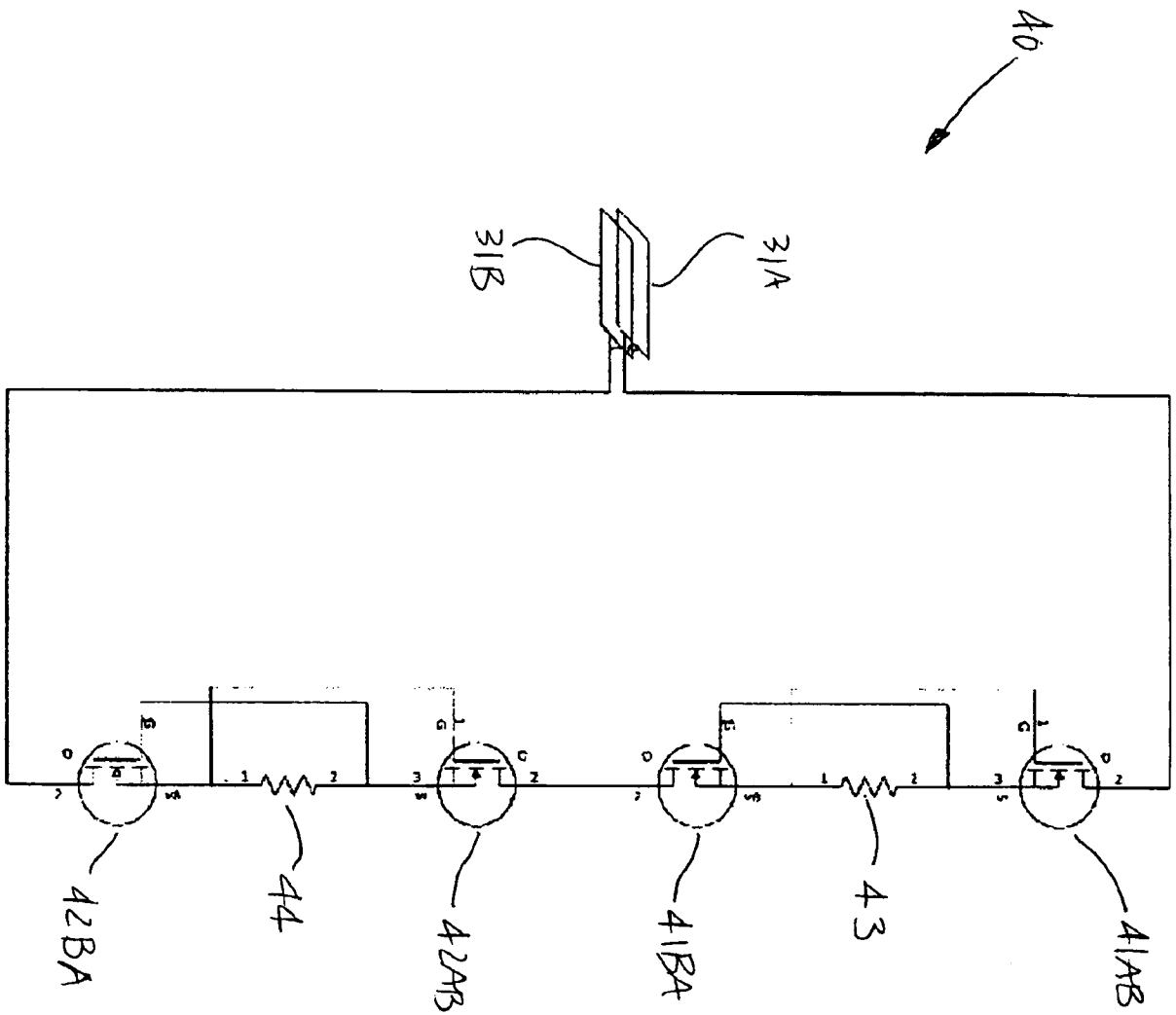
FIG. 5 is a circuit used by the electric-charge protective gear of FIGS. 1 to 4.

In order to overcome the issues associated with prior-art devices, the electric-charge protective device provides variable resistance as a function of the electric charge accumulated by the wearer. The variable resistance of the protective device is offered in the form of a circuit devices exhibiting varying levels of resistance for discharging various levels of electric charge potentials. Referring to FIG. 5, a circuit of the protective device 30 is generally shown at 40, and has the top electrode 31A and the bottom electrode 31B.

When discharge occurs from the wearer to the ground, thus from electrode 31A to electrode 31B, current must pass through transistors 41AB/41BA (first circuit device) and 42AB/42BA (second circuit device). The transistors are in an embodiment depletion-type mosfets (i.e., metal-oxide-semiconductor field-effect transistor), although other types of field-effect transistors can be used as well. The transistors 41AB/41BA and 42AB/42BA are selected so as to vary in resistance according to the discharge potential at one of the electrodes, their transistor threshold voltages and the voltages present at their gate (g), source (s) and drain terminals respectively, so as to operate in a depletion mode. In the present illustration, the depletion mode of operation is assured for transistors 41AB and 42AB when a positive voltage is present at electrode 31A, that is, current flows from wearer to ground, since in such a case, Vgs is negative.

Similarly, the depletion mode of operation is assured for transistors 41BA and 42BA when a positive voltage is present at electrode 31A, that is, current flows from wearer to ground, since in such a case, Vgs is positive.

With negative Vgs voltages present at the respective gate and source terminals of transistors 41AB and 42AB, and positive Vgs voltages present at the respective gate and source terminals of transistors 41BA and 42BA, all the transistors will decrease their conductivity as a function of the potential difference across electrodes 31A and 31B. That is, the overall resistance of the discharge path increases as a function of charge potential on the wearer.

Resistances 43 and 44 are respectively down-stream of the transistors 41AB and 42AB and provide more resistance to the discharge path, as well as means to detect whether or not each transistor shall operate in the depletion mode.

If the voltage present at the electrode 31A, for example, is below a minimum threshold value, the transistors operate such that current does not flow from drain to source (or from source to drain) of transistors 41AB/41BA and 42AB/42BA equally, and thus offer a resistive path with a lower resistance than in the case where the voltage present at the electrode 31A is greater than a threshold value.

If the voltage is above a maximum threshold value, the transistors 41AB/BA and 42AB/BA oppose resistances 43 and 44 to the current, along with their own internal resistances which vary according to the voltage differences established across each of the resistances 43 and 44 respectively.

The action of the transistors 41AB/BA and 42AB/BA combine to define intermediate values between the minimum and the maximum threshold values, with the effect of either one of the resistances 43 and 44 defining the respective operational resistivity or conductivity of each transistor, and thus the overall resistance offered by the resistive discharge path.

In one embodiment provided for illustrative purposes, the protective device 30 opposes an average resistance lower than 0.02 mega ohms for a voltage up to 5 V, an average resistance of about 0.4 mega ohms between 5 V and 100 V, an average resistance of about 1.0 mega ohms between 100 V and 300 V, and an average resistance about of 1.4 mega ohms above 300 V. Other threshold values could be set according to the contemplated use of the protective device. The above-referred threshold values are suitable to allow static charges of the wearer to be safely dissipated to ground, while protecting the wearer against static shock from ground.

It is noted that the protective device 30 offers protection in the case a greater potential is found at electrode 31B (or ground) compared to electrode 31A (wearer) since transistor 42BA (or transistor 41BA in case a single set of transistor is provided) blocks any discharge to the wearer.

The above-described protective device 30 can be adapted to offer similar variable resistance protection in the case a discharge path is required to flow from electrode 31B to electrode 31A (second direction) by inversing the n-type for p-type transistors, and the p-type for n-type in illustration of FIG. 5. Various other configurations are considered as well.

Although the circuit 40 is shown as having pairs of transistor/resistance sets in series in either direction, it is considered to limit the circuit 40 to a pair of transistor/resistance sets in a single direction. Also, a single transistor/resistance set or numerous transistor/resistance sets could be provided for the circuit 40 so as to customize the protective device 30 to its contemplated use.

Figure 3:
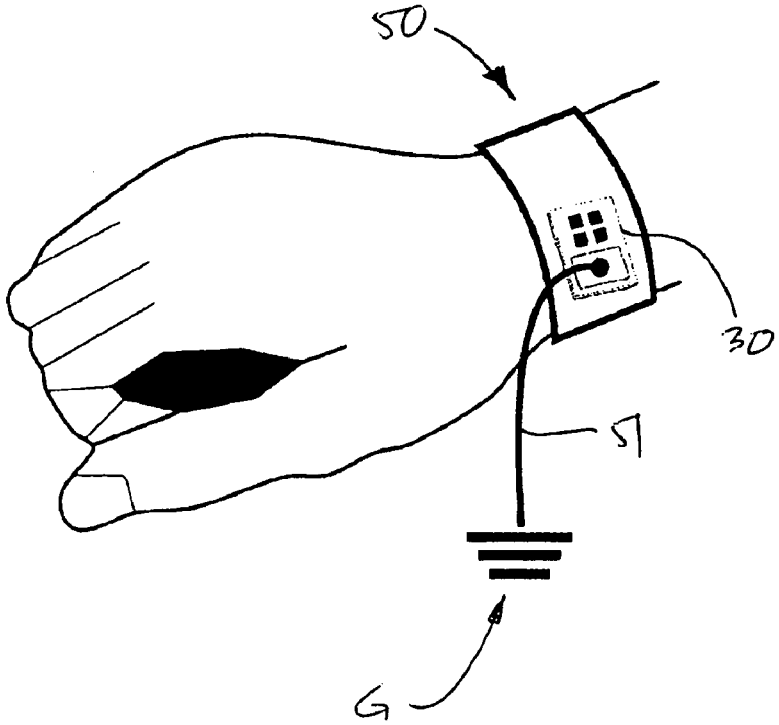
FIG. 3 is a schematic view of an electric-charge protective wrist bracelet in accordance with another embodiment of the present invention.
Figure 4:
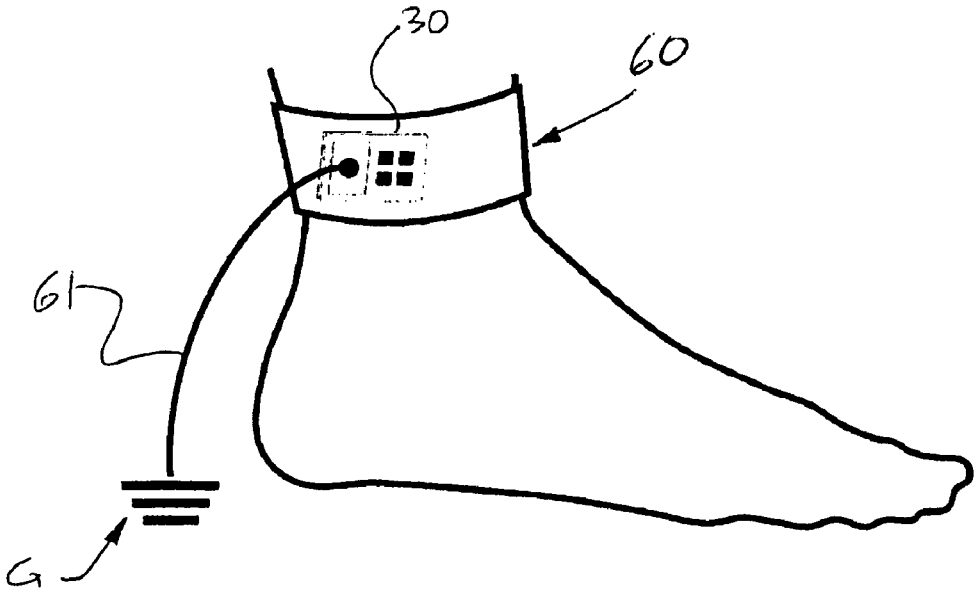
FIG. 4 is a schematic view of an electric-charge protective ankle bracelet in accordance with another embodiment of the present invention.

It is contemplated to provide the variable-resistance protection in other formats. As an example, referring to FIG. 3, an electric-charge protective wrist bracelet is generally shown at 50. The wrist bracelet 50 is conductively connected to wrist of the wearer, and features the protective device 30 as connected to the ground G by way of a wire 51. In another example, referring to FIG. 4, an electric-charge protective ankle bracelet is generally shown at 60. The ankle bracelet 60 is conductively connected to the ankle of the wearer, with the protective device being connected to the ground by way of a wire 61.

The invention claimed is:

1. Protective equipment for safely discharging electrical potential comprising:

an interface adapted to be in contact with a wearer;

a conductive path in the interface contacting the wearer, the conductive path reaching a ground; and a first circuit device in the conductive path, the first circuit device having at least one variable resistance so as to oppose a first level of variable resistance to decrease a conductivity in the conductive path as a function of an increase in potential difference between the wearer and the ground, to allow static discharge through the protective equipment.

2. The protective equipment according to claim 1, wherein the first circuit device comprises a first resistance and a first pair of transistors, with the first pair of transistors arranged with respect to the first resistance so as to offer the first level of variable resistance according to a potential difference across the first resistance in a direction of a current flow.

3. The protective equipment according to claim 2, further comprising a second circuit device in the conductive path in series with the first circuit device, the second circuit device having a second resistance and a second pair of transistors, with the second pair of transistors being arranged with respect to the second resistance so as to offer a second level of variable resistance according to a potential difference across the second resistance in a direction of a current flow.

4. The protective equipment according to claim 2, wherein the transistors of the first pair are mosfets, with the transistors arranged on opposed sides of the first resistance so as to operate in depletion mode when current flows from the wearer to the ground.

5. The protective equipment according to claim 3, wherein the transistors of the first pair and of the second pair are mosfets, with the transistors of the first pair and of the second pair respectively arranged on opposed sides of the first resistance and of the second resistance so as to operate in depletion mode when current flows from the wearer to the ground.

6. The protective equipment according to claim 1, wherein the interface is a shoe, the shoe having an insole, an insulating midsole, and an outsole, with the circuit device being accommodated in the midsole and in contact with the insole and the outsole.

7. The protective equipment according to claim 6, wherein the insole has a conductive ribbon in contact with a conductive layer and with the circuit device, the conductive layer contacting a foot of the wearer.

8. The protective equipment according to claim 6, wherein the outsole comprises at least one of a conductive heel portion and a conductive tab portion in contact with the circuit device.

9. The protective equipment according to claim 1, wherein the interface is any one of a wrist band and an ankle band, with the interface being grounded.

* * * * *